United States Patent [19]

Norman et al.

[11] Patent Number: 4,759,380

[45] Date of Patent: Jul. 26, 1988

[54] FILTER CIGARETTE HAVING SEGMENTED SECTIONS

[75] Inventors: Alan B. Norman, Clemmons; Thomas A. Perfetti, Winston-Salem; Barry L. Saintsing; Kenneth W. Swicegood, both of Lexington, all of N.C.

[73] Assignee: R. J. Reynolds Tobacco Company, Winston-Salem, N.C.

[21] Appl. No.: 926,292

[22] Filed: Nov. 3, 1986

[51] Int. Cl.[4] ..... A24D 1/00; A24D 1/04

[52] U.S. Cl. ..... 131/364; 131/360

[58] Field of Search ..... 131/360, 361, 364

[56] References Cited

U.S. PATENT DOCUMENTS

| | | | |
|---|---|---|---|
| 1,721,117 | 7/1929 | Hopkins . | |
| 1,796,522 | 3/1931 | Hopkins | 131/364 |
| 3,759,267 | 9/1973 | Thornton | 131/364 |
| 3,902,504 | 9/1975 | Owens, Jr. et al. | 131/364 |
| 4,009,722 | 3/1977 | Wahle et al. . | |
| 4,328,817 | 5/1982 | Naylor et al. . | |
| 4,434,804 | 3/1984 | Bolt et al. . | |
| 4,516,585 | 5/1985 | Pinkham . | |
| 4,595,024 | 6/1986 | Greene et al. . | |

*Primary Examiner*—V. Millin

[57] ABSTRACT

Filter cigarettes can be manufactured in a highly cost effective manner. Filter cigarettes include a tobacco rod having two segments of smokable material. The first segment is positioned at the lighting end of the cigarette and includes expensive, normally high quality tobaccos. The second segment is positioned at the filter end of the rod and includes cost effective smokable materials. A cellulose acetate filter element is axially aligned with the rod and is positioned adjacent to the second segment. Tipping material attaches the filter element to the tobacco rod. The second segment extends along the rod up to about 20 mm past the foremost point which the tipping material extends. The combined longitudinal length of the filter element and the second segment extends up to about 60 percent of the total length of the smoking article.

16 Claims, 1 Drawing Sheet

FILTER CIGARETTE HAVING SEGMENTED SECTIONS

BACKGROUND OF THE INVENTION

This invention relates to cigarettes, and in particular to such cigarettes having a tobacco containing rod and a filter element attached to one end thereof.

Popular smoking articles such as cigarettes have a substantially rod shaped structure and include a charge of smokable material such as tobacco surrounded by a wrapper such as paper thereby forming a tobacco rod. Typically, blends of tobacco materials are employed in cigarette manufacture. However, it is desirable to employ blends including certain amounts of reclaimed, reconstituted or processed tobaccos in order to reduce the cost of the ultimate product. It has been desirable to provide cigarettes having cylindrical filters aligned in an end-to-end relationship with the tobacco rod. Typically, filters are constructed from fibrous materials such as cellulose acetate and are attached to the tobacco rod using a circumscribing tipping material.

Typical cigarettes include tobacco rods ,having lengths which range from about 50 mm to about 85 mm, and filter elements which abut one end of the tobacco rod and have lengths which range from about 20 mm to about 35 mm. The tipping material circumscribes the filter element and an adjacent region of the rod. Typically, tipping materials extend from about 20 mm to about 40 mm along the length of the cigarette. The inner surface of the tipping material is adhesively secured to the outer surface of the filter element and to the wrapper of the tobacco rod. The tipping material circumscribes the rod over a longitudinal length which is sufficient to provide good attachment of the filter element to the tobacco rod. In addition, for most practical applications, the tipping material acts as limiting factor in determining the length to which the tobacco rod is smoked. Typically, the tipping material extends from about 3 mm to about 6 mm along the length of the tobacco rod.

When a filter cigarette is employed, the tobacco rod generally is burned to within about 3 mm of the tipping material. Such a practice can tend to leave remaining at a minimum about 6 mm to about 9 mm of unused tobacco material. As the remaining tobacco material generally is of high quality, such a practice is wasteful and not highly cost effective.

In view of the deficiencies attendant in the manufacture of filter cigarettes, it would be highly desirable to manufacture in a highly cost effective manner a cigarette having a high quality tobacco material wherein the aforementioned waste of the high quality tobacco material is minimized.

SUMMARY OF THE INVENTION

The present invention relates to a smoking article in the form of a filter cigarette. The cigarette includes a rod of smokable material contained in a circumscribing wrapping material, and the two ends thereof are open to expose the smokable material. The cigarette also includes a filter element axially aligned with the rod in an end-to-end relation adjacent to the end of the rod. Tipping material circumscribes and is fixedly attached to both the filter element and the rod in a region adjacent the filter element. The aforementioned rod has at least two segments of smokable material therewithin and each segment is defined by its composition. The first segment is disposed at the end of the rod which is to be lit (i.e., the foremost end of the cigarette). The second segment is disposed at the end of the rod adjacent the filter element. Each of the first and second segments has a substantially uniform composition in the region along the longitudinal axis of the rod and across the rod in a plane perpendicular to the longitudinal axis thereof. The aforementioned filter element and the region of the rod adjacent the filter element are circumscribed by tipping material such that the tipping material overlies at least a portion of the second segment of smokable material. The second segment extends up to about 20 mm beyond the foremost point which the tipping material extends. In addition, the filter element and the second segment of smokable material have a combined longitudinal length of up to about 60 percent of the total length of the smoking article.

Filter cigarettes of this invention can be readily manufactured, can have second segments composed of highly cost effective materials, can have relatively short cellulose acetate filter elements, can have a wide range of lengths of tipping materials, and can exhibit surprisingly similar organoleptic properties as compared to conventional blend cigarettes having lesser amounts of cost effective materials. Of particular interest is a cigarette having a relatively long second segment, a relatively short filter element, and a relatively short first segment.

DETAILED DESCRIPTION OF THE EMBODIMENTS

Figure 1:
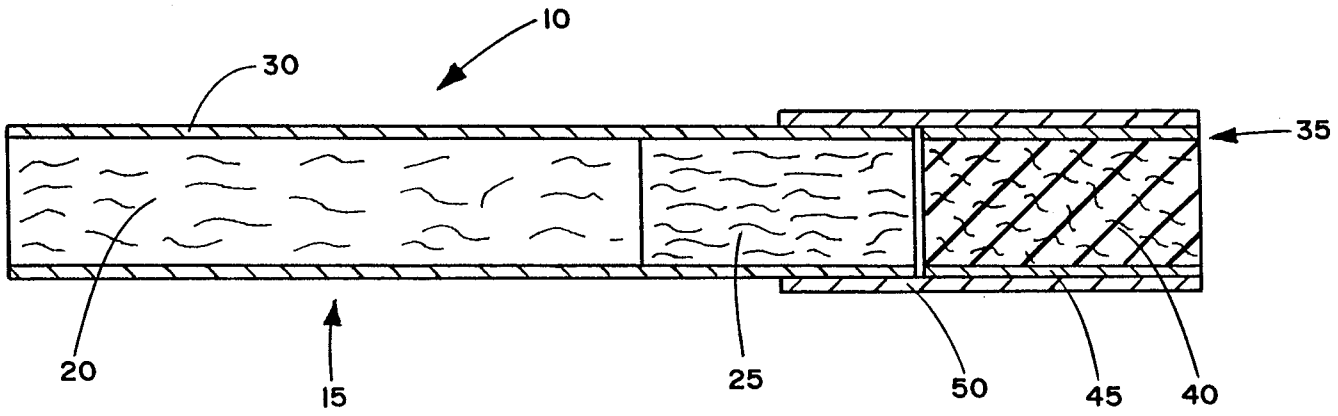
FIG. 1 is a diagrammatic cross sectional illustration of a cigarette showing the rod having two segments of smokable material and the filter element attached to one end of the rod using the tipping material.

An embodiment of the invention shown in FIG. 1 is a smoking article 10 in the form of a cigarette. The cigarette comprises a generally cylindrical rod 15 having two segments of smokable material. Typically, the length of the rod ranges from about 50 mm to about 85 mm, and the circumference of the rod ranges from about 19 mm to about 27 mm. First segment 20 is positioned or disposed at the end of the cigarette which is to be lit (i.e., the foremost end of the cigarette). Second segment 25 is positioned or disposed at the end of the rod opposite the first segment (i.e., towards the mouthend of the cigarette relative to the first segment). For the embodiment shown, the segments each are aligned in an abutting, end-to-end relationship and are contained in the circumscribing wrapping material 30 thereby forming the rod 15. Typically, the wrapping material is a conventional cigarette wrapping paper. The ends of the rod are open to expose the smokable material.

The smoking article further comprises filter element 35 positioned adjacent to one end of rod 15 such that the filter element is axially aligned with the rod in an end-to-end relationship. Filter element 35 has a substantially cylindrical shape, and the diameter thereof is substantially equal to the diameter of the rod. Preferably, the filter element substantially abuts the rod. The ends of the filter element are open to permit the passage of air and smoke therethrough. The filter element comprises filter material 40 which is overwrapped along the longitudinally extending surface thereof with circumscribing wrap material 45. The filter material can be cellulose acetate, or other suitable material. The wrap material can be air permeable or air impermeable material such as conventional paper plug wrap. However, if desired a nonwrapped cellulose acetate plug can be employed as a filter element. Typically, the longitudinally extending length of the filter element ranges from about 10 mm to about 35 mm.

Filter element 35 is attached to rod 15 by tipping material 50 which circumscribes both the entire length of the filter element and an adjacent region of the rod. The inner surface of the tipping material is fixedly secured to the outer surface of the wrapping material and to the outer surface of the wrapping material of the adjacent region of the rod using a suitable adhesive. The tipping material extends over the rod in that segment overlying at least a portion of the second segment of smokable material.

Each segment of smokable material is defined by its composition. By this is meant that the smokable material forming the first segment is different in composition from the smokable material forming the second segment. For the highly preferred embodiments of this invention, the smokable material forming the first segment (e.g., the blend of materials forming the first segment) is of higher quality than the smokable material forming the second segment (e.g., the blend of materials forming the second segment). By the terms "high quality" or "higher quality" is meant tobacco based on U.S. Standard Grading System that have tobacco group categories of Wrapper, Leaf or Smoking Leaf, are choice or fine in grade quality, have superior color or texture, have a highly desirable aroma, and have acceptable chemical and physical assessments (e.g., nicotine and sugar content, and tactile properties). Tobaccos of such quality or type are normally more expensive than lesser or lower quality tobaccos, processed tobaccos, or reconstituted tobacco materials. The aforementioned U.S. Standard Grading System is a comprehensive method for grading Virginia, Maryland and burley tobaccos, although similar criteria can be used in determining the quality of oriental tobaccos. See *Tobacco Encyclopedia,* edited by Ernst Voges, published by TJI (1984).

The smokable material forming the first segment can vary. Most preferably, the smokable material includes cured and aged flue-cured, burley, Maryland or oriental tobaccos, or blends thereof; or blends including rare or specialty tobaccos such as perique, latikia or dark-fired tobaccos. If desired, the aforementioned cured, aged or fermented tobaccos can be blended with minor amounts of processed tobacco material such as expanded tobaccos, processed tobacco stems, or reconstituted tobaccos. Although less desirable, the blend of smokable material forming the first segment can include amounts of tobacco substitute materials and/or pyrolyzed or carbonized materials. The smokable materials generally are employed as in conventional cigarette manufacture. For example, the smokable materials are employed in the form of strands (e.g., as strands cut at about 32 cuts per inch) and treated with additives such as flavorants and humectants.

The smokable material forming the second segment can vary. Most preferably, the smokable material includes a major portion of lower quality or inexpensive tobaccos, processed tobacco materials such as reconstituted tobaccos, processed stems, expanded tobaccos, and blends thereof. If desired, the smokable material forming the second segment can include pyrolyzed or carbonized materials, as well as tobacco substitute materials such as puffed grains. The smokable materials typically are employed in the form of strands as in conventional cigarette manufacture.

The term "segment" in referring to the smokable material contained within the rod means the portion of the rod extending longitudinally along the rod, and bounded by a plane at each end of the segment, which plane is positioned substantially transversely to the longitudinal axis of the rod. For a substantially cylindrical rod, the two segments of smokable material form two substantially cylindrical shaped segments within the tubular wrap, and are aligned in an essentially abutting and end-to-end relationship. The boundary between the segments can be relatively abrupt, providing a discrete, rapid transition of smokable material therebetween.

The amount which the two segments extend longitudinally along the cigarette can vary. The first segment, for example, can extend from about 40 to about 60 percent of the longitudinal length of the cigarette; while the second segment, for example, can extend from about 20 to about 50 percent of the longitudinal length of the cigrarette.

The filter element can have a length which can vary. Typically, the length of the filter element ranges from about 10 mm to about 40 mm, preferably from about 16 mm to about 31 mm.

The tipping material circumscribes the filter element and the rod such that at least a portion of the second segment of smokable material is covered by the tipping material. Preferably, the second segment extends beyond the foremost point which the tipping material extends. However, the second segment extends a longitudinal distance of less than about 20 mm, preferably from about 6 mm to about 13 mm, beyond the foremost point which the tipping material extends. If desired, the tipping material can extend a sufficient distance to cover the second segment as well as a portion of the first segment. The tipping material generally extends from about 15 mm to about 45 mm, preferably from about 25 mm to about 35 mm, along the longitudinal length of the article.

The combined longitudinal length of the filter element and second segment can extend up to about 60 percent of the total length of the smoking article. Preferably, the combined length ranges from about 20 to about 50 percent of the total length of the smoking article.

There are numerous possible combinations of segment length ratios, filter lengths and lengths of tipping materials that can be employed herein. The length of the tipping material can be determinative in providing the objectives desired by the cigarette designer and the consumer. Additionally, the large number of combinations of the variables can provide products of reduced cost relative to conventionally prepared products. Of particular interest are cigarettes having relatively great amounts of cost effective materials in the second segment. However, the cost effective materials can be used in relatively great amounts without affecting, to any significant degree, the taste characteristics of the cigarette. In addition, changes in filter parameters (e.g., filter length, type of tow material, total denier, denier per filament characteristics, etc.) and changes in the density of the second segment can be made in order to provide a product having a range of desired deliveries for cigarettes having rods including particular first and second segment lengths. Furthermore, the delivery of a cigarette can be modified in a controlled manner by varying the length of the second segment relative to the length of the first segment. If desired, such an ability to modify the delivery of a cigarette can be employed in conjunction with differing filter elements having differing filtration efficiencies thereby providing the skilled artisan with an efficient and effective method for controlling the delivery of a cigarette.

Cigarette rods can be manufactured using the apparatus described in U.S. Pat. No. 4,516,585 to Pinkham; or using the apparatus described in U.S. Pat. No. 4,009,722 to Wahle et al. The rods so manufactured have the desired segments of smokable material. If desired, rods can be manufactured having segments of varying packing densities and nicotine levels, as is described in U.S. Pat. No. 4,595,024 to Greene et al. Filter elements of the desired length are attached to the rods using tipping material and techniques known in the art.

The following examples are given to further illustrate the invention but should not be considered as limiting the scope thereof. Unless otherwise noted, all parts and percentages are by weight.

EXAMPLE 1

Cigarettes having lengths of 84 mm and circumferences of 24.8 mm are provided as follows: Cigarette tobacco rods have lengths of 68 mm and comprise 2 segments of smokable material contained in conventional cigarette wrapping paper. The first segment is a blend of about 15 percent burley tobacco, about 55 percent flue cured tobacco and about 30 percent oriental tobaccos. The second segment is a lower quality blend than the blend of the first segment and is a blend of expanded tobacco and reconstituted tobacco. The blend of the second segment includes about 38 percent of a mixture of lower quality expanded flue-cured and burley tobaccos, and about 62 percent reconstituted tobacco. The tobacco materials employed in the first and second segments are in the form of strands cut at about 32 cuts per inch. The segments are generally cylindrical in shape. The rods are manufactured using an apparatus and process generally described in U.S. Pat. No. 4,009,722 to Wahle et al.

A cellulose acetate filter element having a circumscribing paper plug wrap and having a length of 6 mm is positioned in an abutting end-to-end relationship with the end of the rod so as to be positioned adjacent the second segment. The cellulose acetate tow forming the filter element is 4.2 denier per filament, 40,000 total denier having a "Y" cross section. Tipping material having a 30 mm length extends from the extreme mouthend of the cigarette and over the filter element as well as over about 14 mm of the rod. The tipping material circumscribes and is adhesively secured to the filter element and the rod in the 14 mm extending length adjacent to the filter element.

Cigarettes having varying first and second segment lengths are manufactured in this manner, and are designated as Sample Nos. 1–4.

For comparison purposes, Sample No. C-1 is manufactured. The comparative cigarette is constructed as are Sample Nos. 1–4, except that the comparative sample includes a rod having a blend of tobaccos rather than first and second segments. The blend employed in the manufacture of Sample No. C-1 is (i) about 60 percent of the previously described blend of burley, flue-cured and oriental tobaccos, and (ii) about 40 percent of the previously described blend of expanded and reconstituted tobaccos. The length of tipping material is 35 mm, and the tipping material extends from the extreme mouthend of the cigarette over the length of the filter element as well as about 19 mm of the rod in the region adjacent the filter element.

For comparison purposes, Sample No. C-2 is manufactured. The comparative cigarette manufactured as is Sample No. C-1, except that the filter element has a length of 21 mm and the rod has a length of 63 mm. In addition, the cellulose acetate filter element for Sample No. C-2 is 3.3 denier per filament, 44,000 total denier having a "Y" cross section. Tipping material having a 33 mm length extends from the extreme mouthend of the cigarette and over the filter element as well as over about 12 mm of the rod.

Data concerning cigarette Sample Nos. 1–4 as well as data concerning (i) the FTC "tar" and nicotine values, and (ii) the draw properties of the cigarette are presented in Table I:

TABLE I

| Sample | Length of First Segment (mm) | Length of Second Segment (mm) | No. of[1] Puffs | Butt Length (mm) | FTC "Tar" (mg) | Avg. FTC "Tar" per Puff (mg) | FTC Nicotine (mg) | Avg. FTC Nicotine per Puff (mg) | Pressure[2] Drop |
|---|---|---|---|---|---|---|---|---|---|
| 1 | 54.4 | 13.6 | 9.4 | 33 | 21.8 | 2.32 | 1.72 | 0.183 | 111 |
| 2 | 47.6 | 20.4 | 9.7 | 33 | 20.3 | 2.09 | 1.58 | 0.163 | 119 |
| 3 | 40.8 | 27.2 | 8.5 | 33 | 15.2 | 1.79 | 1.13 | 0.133 | 167 |
| 4 | 34 | 34 | 8.2 | 33 | 14.8 | 1.81 | 1.10 | 0.135 | 156 |
| C-1* | — | — | 7.6 | 38 | 17.0 | 2.25 | 1.00 | 0.132 | 113 |
| C-2* | — | — | 7.5 | 36 | 13.4 | 1.79 | 0.93 | 0.125 | 136 |

*not an example of the invention.
[1]No. of Puffs is the number of puffs obtained under standard FTC smoking conditions. FTC conditions consist of 2 seconds of puffing (35 ml total volume) separated by 58 seconds of smolder.
[2]Pressure Drop is presented in mm of water pressure drop as measured using an Filtrona Model No. FTS-300 encapsulated pressure drop tester at an airflow rate of 17.5 cc/sec.

The data in Table I indicate that the "tar" and nicotine deliveries of Sample Nos. 1–4 decrease as the lengths of the respective second segments increase. Surprisingly, the "tar" of Sample No. C-1 (which contains an amount of blend components similar to Sample No. 3) delivers an amount of "tar" per puff similar to Sample No. 1.

Evaluation of the organoleptic properties of the various samples indicate that Sample Nos. 1 and 2 are judged by a smoking panel to be similar organoleptically in many respects to Sample No. C-2, even though Sample Nos. 1 and 2 are significantly higher in FTC "tar" and nicotine than Sample No. C-2. In addition, Sample Nos. 3 and 4 are judged by a smoking panel to be similar in many respects organoleptically to Sample No. C-2. The organoleptic evaluation does indicate a very slight perceived organoleptic difference between Sample Nos. 1–3 and Sample No. 4. Such behavior is expected in that the second segment of Sample No. 4 extends about 20 mm past the foremost region of the tipping material. Thus, the sensory evaluations indicate that the length that the second segment of lower quality material extends along the rod can be varied up to that length which extends about 20 mm past the foremost point of the tipping material without perceived differences in organoleptic properties. The organoleptic evaluation does indicate some evaluated perceptions of cigarette "strength" related criteria for Sample Nos. 1 and 2 relative to Sample Nos. 3, 4 and C-2. However, the differences are not considered to be relevant across the various samples. Rather, the slight differences in "strength" related perceptions are consistent with the substantial reduction in FTC "tar" of the samples.

Surprisingly, Sample Nos. 1–4, even through being of varying amounts of certain tobacco components and delivering differing amounts of "tar" and nicotine, are adjudged to have similar organoleptic properties.

What is claimed is:

1. A smoking article in the form of a filter cigarette having in combination (i) a rod having smokable material contained in a circumscribing wrapping material, and having the two ends thereof open to expose the smokable material, (ii) a filter element axially aligned in an end-to-end relations hip adjacent one end of the rod; and (iii) tipping material circumscribing and being fixedly attached to both the filter element and the rod in a region adjacent the filter element;

(a) the rod having two segments of smokable material therewithin, each segment being defined by its composition, wherein the first segment is disposed at the end of the rod which is to be lit and the second segment is disposed at the end of the rod adjacent the filter element and the first and second segments are aligned in an abutting end-to-end relationship, and wherein each of the first and second segments has a substantially uniform composition in the region along the longitudinal axis of the rod and across the rod in a plane perpendicular to the longitudinal axis thereof, (b) the filter element and the region of the rod adjacent the filter element being circumscribed by tipping material such that the tipping material overlies at least a portion of the second segment of smokable material, and the second segment extends up to about 20 mm beyond the foremost point which the tipping materials extends, (c) the filter element and the second segment of smokable material having a combined longitudinal length of up to about 60 percent of the total length of the smoking article, and the first segment extending about 40 percent or more of the total length of the smoking article, and (d) the smokable material of the first segment being of a higher quality than the smokable material of the second segment.

2. The cigarette of claim 1 wherein the filter element has a longitudinal length ranging from about 10 mm to about 40 mm.

3. The cigarette of claim 1 wherein the filter element has a longitudinal length ranging from about 16 mm to about 31 mm.

4. The cigarette of claim 1 wherein the first segment extends from about 40 to about 60 percent of the total length thereof; and the second segment extends from about 20 to about 50 percent of the total length thereof.

5. The cigarette of claim 1 wherein the tipping material extends from about 15 mm to about 45 mm along the longitudinal length thereof.

6. The cigarette of claim 1 wherein the tipping material extends from about 25 mm to about 35 mm along the longitudinal length thereof.

7. The cigarette of claim 1 wherein the second segment extends from about 6 mm to about 13 mm beyond the foremost point which the tipping material extends.

8. The cigarette of claim 1 wherein the smokable material of the second segment comprises reconstituted tobacco material, expanded tobacco material, processed tobacco stems, or a blend thereof.

9. The cigarette of claim 1 having a total length of about 85 mm to about 100 mm.

10. The cigarette of claim 1 having a circumference of about 24.8 mm.

11. The cigarette of claim 3 wherein the first segment extends from about 40 to about 60 percent of the total length thereof; and the second segment extends from about 20 to about 50 percent of the total length thereof.

12. The cigarette of claim 3 wherein the tipping material extends from about 25 mm to about 35 mm along the longitudinal length thereof.

13. The cigarette of claim 12 wherein the second segment extends from about 6 mm to about 13 mm beyond the foremost point which the tipping material extends.

14. The cigarette of claim 12 wherein the smokable material of the second segment comprises reconstituted tobacco material, expanded tobacco material, processed tobacco stems, or a blend thereof.

15. The cigarette of claim 13 wherein the smokable material of the second segment comprises reconstituted tobacco material, expanded tobacco material, processed tobacco stems, or a blend thereof.

16. The cigarette of claim 13 having a total length of about 85 mm to about 100 mm.

* * * * *